US006913522B2

(12) United States Patent
Junker

(10) Patent No.: US 6,913,522 B2
(45) Date of Patent: Jul. 5, 2005

(54) METHOD AND DEVICE FOR GRINDING CENTRAL BEARING POSITIONS ON CRANKSHAFTS

(75) Inventor: Erwin Junker, Buehl/Baden (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 0 days.

(21) Appl. No.: 10/489,529

(22) PCT Filed: Sep. 10, 2002

(86) PCT No.: PCT/EP02/10135

§ 371 (c)(1),
(2), (4) Date: Apr. 20, 2004

(87) PCT Pub. No.: WO03/022521

PCT Pub. Date: Mar. 20, 2003

(65) Prior Publication Data

US 2004/0248502 A1 Dec. 9, 2004

(30) Foreign Application Priority Data

Sep. 11, 2001 (DE) ..... 101 44 644

(51) Int. Cl.[7] ..... B24B 1/00

(52) U.S. Cl. ..... 451/49; 451/28; 451/51; 451/57; 451/58; 451/177; 451/178; 451/282; 451/364; 451/365; 451/388; 451/397; 451/398

(58) Field of Search ..... 451/28, 49, 51, 451/57, 58, 177, 178, 282, 364, 365, 385, 397, 399

(56) References Cited

U.S. PATENT DOCUMENTS 4,485,593 A * 12/1984 Munzing et al. ..... 451/249
4,790,698 A * 12/1988 Heffron ..... 409/200

FOREIGN PATENT DOCUMENTS

FR 1 487 669 7/1967
WO 00 66323 11/2000

* cited by examiner

*Primary Examiner*—Joseph J. Hail, III
*Assistant Examiner*—Shantese McDonald
(74) *Attorney, Agent, or Firm*—Jordan and Hamburg LLP

(57) ABSTRACT

An apparatus for grinding center bearings of crankshafts includes a clamping unit for clamping and driving a crankshaft; a grinding spindle, positionable perpendicular to the crankshaft; a plurality of grinding wheels on the grinding spindle, corresponding to the number of center bearings to be ground; a plurality of steadies, for supporting the crankshaft, opposite the grinding spindle; and an additional processing unit for performing preliminary grinding on the center bearing, by forming an elevated bearing seat for the steadies, opposite the bearing, such that the steadies are continuously guidable during grinding of the center bearings. In a method for grinding center bearings of a crankshaft using the apparatus, the center bearings are simultaneously ground using a multilayer grinding wheel set, and prior to a final grinding of the center bearings to their final dimensions, a bearing seat for a steady is ground on at least one center bearing.

10 Claims, 5 Drawing Sheets

METHOD AND DEVICE FOR GRINDING CENTRAL BEARING POSITIONS ON CRANKSHAFTS

The present invention relates to an apparatus for grinding center bearings, specifically of crankshafts and to a method for performing such grinding.

There are a number of options available for performing grinding of center bearings or main bearings of mass-produced crankshafts.

For instance, the center bearings can be ground by means of individual grinding wheels, which however is associated with substantially higher grinding time because each main bearing is processed individually. Furthermore, a relatively complex machine design is required in order to ensure flexibility for such a grinding process.

Furthermore known, but not very common in mass production, is processing these bearings on the crankshafts by means of so-called "centerless" grinding.

The most widely used method in mass production is so-called multilayer grinding, in which a plurality of grinding wheels of one grinding spindle simultaneously come into contact with the crankshaft at the aforesaid locations of each main bearing. The machines employed for this have been known for some time and have a design such that an adjusting unit is constructed on a machine bed by means of a grinding spindle and a dressing apparatus. The dressing apparatus preferably moves into place linearly in the direction of an axis that runs transverse to the main axis or center axis of rotation of the crankshaft. Arranged in the region in front of such a grinding machine is a grinding table that is either installed fixed on the machine bed or can be moved by means of a computer numerically controlled (CNC) axis in the direction of an axis that runs transverse to the adjusting axis and parallel to the axis of rotation. Installed on this grinding table are a workpiece spindle head and a tailstock, whereby the workpiece spindle head contains the workpiece spindle. The workpiece spindle acts in a known manner to receive a chuck or a carrier for the crankshaft. The tailstock is likewise installed on the grinding table and is manually displaceable for adjusting to various lengths of the crankshaft. A tailstock sleeve can be moved forward and backward automatically for loading and unloading the crankshaft, as is generally known for conventional cylindrical grinding machines.

There are two options for clamping the crankshaft, which occurs on the spindle head side: either a floating carrier system or center clamping chucks. The workpiece spindle head and thus the crankshaft are caused to rotate by means of a motor. The tailstock sleeve is provided with a corresponding countertip that in general is embodied as a so-called standing tip. The crankshaft is then received between these tips at its center between the workpiece spindle head and the tailstock sleeve, which ensures that the center axes of the workpiece spindle and the tailstock sleeve are precisely aligned with the center axis, i.e., axis of rotation, of the crankshaft.

For precisely monitoring the grinding process, the workpiece is measured in real time during grinding by means of two measuring devices and the machine is correspondingly corrected.

As a rule, aluminum grinding wheels are in widespread use in the described multilayer grinding method, in particular in crankshaft production. These machines are characterized in that they have a wear amount of approx. 1,100 to 600 mm in the grinding wheel diameter. It can be assumed that dressing must be performed after every 20 to 30 crankshafts ground and the dressing amount will be on the order of approx. 0.03 mm.

In the multilayer grinding method, it is advantageously possible to grind center bearings or main bearings that have lateral undercuts, that is, no face sides are ground. In addition, it is also possible to also grind main bearings with lateral radius transitions to this face side as well as the face side to this main bearing with a height of approx. 4 to 5 mm.

Grinding of such main bearings with lateral radius transitions and any face sides proves to be substantially more difficult, since in this case the method is much more critical in terms of the grinding technology used.

Furthermore, with the multilayer grinding method on crankshafts, it is also possible to perform grinding of its center bearings or main bearings with or without lateral radius transitions and any face sides, as well as grinding center sections on the flange or journals, whereby however no face surfaces are ground at the same time on these center sections of the flange and journals.

Depending on the size and design of a crankshaft to be ground, the steadies are employed during grinding for support thereof, especially when grinding with aluminum grinding wheels, due to the grinding pressure on the crankshaft generated by the grinding wheel.

This problem of elevated grinding pressure with associated higher cutting forces also occurs with so-called cubic boron nitride (CBN) grinding wheels, since increased metal must be removed with them in order to make the grinding process economically feasible in general. However, this is not entirely due to the required clocklime, which should be achieved in a desired manner, but is also due to the properties of the CBN grinding wheel itself. CBN grinding wheels, preferably those that are ceramic bound and have a coating height of approx. 5 mm, have the advantage that they can be operated at an increased cutting volume, but they also suffer from the disadvantage that the cutting forces are higher due to the specifications of the grinding wheels, whereby the entire grinding process becomes technically substantially more difficult.

However, a major advantage of grinding with CBN grinding wheels is that they can be operated at increased cutting volumes and that the dressing cycles increase approximately ten-fold, which means that the overall production and non-production times spent on finishing one crankshaft are substantially lower. This makes possible increased output of crankshafts per unit of time.

Employment of such CBN grinding wheels is desirable, but the increased grinding pressure during grinding renders initial grinding of the crankshaft in the region of a main bearing, at least up to the placement of the support steady during grinding, particularly problematic in terms of grinding technology.

Given these considerations, it is the object of the present invention to develop a method and an apparatus that represents a substantial improvement in terms of grinding the steady seat.

This object is achieved with an apparatus in accordance with the features of claim 1 and with a method in accordance with the features of claim 8.

Fundamentally, when grinding the steady rest it is very important that, first, it runs very true with respect to the main bearing to be ground, and, second, it has very good roundness in this respect.

In accordance with the invention, therefore, the apparatus is distinguished in that provided for preliminary work at least on one center bearing of the crankshaft is an additional processing unit that is provided for the bearing seat for placing a steady for the final process of multilayer grinding.

Preferably the processing unit is an additional grinding unit with at least one grinding wheel for grinding processing of the center bearing of the crankshaft provided for the steady bearing seat.

In this case it is advantageous when the at least one grinding wheel of the processing unit has a narrower width than the width of the center bearing so that the ground running track created for the steady on the main bearing is wide enough that the steady jaws can be placed with no problem. The ground running track that is produced by the narrow grinding wheel must be at least approx. 2 mm wider than the steady jaws themselves. This process is used primarily when the main bearing must be ground with corner radii.

In accordance with the invention, the additional processing unit can either be moved into place toward the crankshaft or pivoted into place if the grinding wheel is situated in a non-contact position with the crankshaft for the final multilayer grinding of the crankshaft.

In accordance with the invention, multilayer grinding is performed such that, prior to grinding the center bearings to their final dimensions, at least the bearing that will act as the bearing seat for a steady is pre-ground. That is, all of the processing steps are performed with the workpiece clamped.

In accordance with the invention, there are two fundamentally different options for this. When grinding main bearings with lateral undercuts in which the face side of the main bearing is not also ground, the procedure is possible without using a so-called additional grinding device, as described in the foregoing in connection with the inventive apparatus. In this case it is necessary that an elevated contour remains on the main bearing of the crankshaft during preliminary processing by mean of rotational milling or turning so that then during subsequent multilayer grinding in a grinding machine for multilayer grinding this elevation is first ground off. The elevation must be at least the width of the steady seat to be produced, whereby this elevation must already be ground clean before an adjacent main bearing is processed with the grinding wheel set. In other words, optimum values can also be achieved here with respect to the required accuracy in terms of trueness of the runs and roundness. Then the steady is placed on this ground running track and subsequently the grinding wheel set of the grinding spindle is moved into place and the main bearing or bearings are ground until they are finished.

Another option is to begin grinding the steady seat by means of a grinding wheel as described in the foregoing in connection with the apparatus, whereby an additional grinding device is employed within the grinding machine.

In both cases, in accordance with the invention the steady is always guided for smooth counterbearing while the bearing undergoes multilayer grinding to its final dimensions, whereby measuring devices automatically measure the crankshaft during the process so that the grinding process can run practically identical to grinding with the aluminum grinding wheel.

The method/apparatus in accordance with the invention described in the foregoing are explained in greater detail in the following using the exemplary embodiments illustrated in the drawings.

Figure 1:
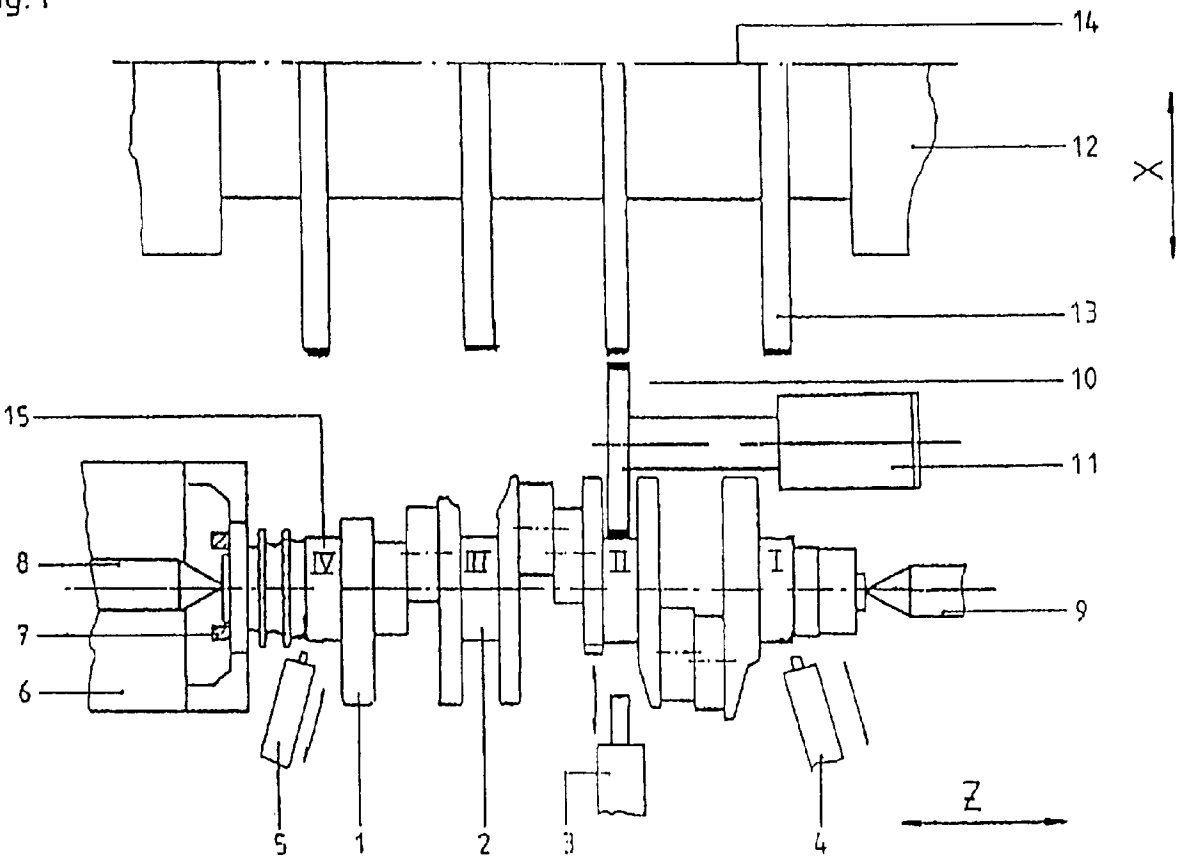
FIG. 1 is a schematic top view of a grinding cell of the inventive apparatus while grinding the steady seat.

FIG. 1 is a simplified representation in the form of a top view, whereby a crankshaft 1 is illustrated with the clamp and grinding wheel set 12, 13. The crankshaft 1 is received in a floating chuck 6 with a tip 8 in the center of the crankshaft 1 and is positioned longitudinally by a longitudinal stop 7.

The floating-borne clamping jaws of the chuck 6 clamp the crankshaft 1 at its flange so that it provides radial travel for grinding.

The crankshaft 1 is also received by a centering tip 9 on the side of the tailstock so that the crankshaft 1 is received and clamped at both ends in its centerings, which have already been processed, whereby it is positioned precisely for grinding in terms of position and clamping.

Furthermore illustrated are the measuring devices 4 and 5 installed on the grinding table; however, these do not come into contact with the crankshaft during grinding of the steady seat.

The steady 3 is also installed on the grinding table, but during grinding of the steady seat it necessarily does not have its jaws on the workpiece.

The crankshaft 1 has a plurality of main bearings 15, namely in the present example I, II, III, and IV. Grinding of the steady seat occurs in the illustration shown in FIG. 1 at the center rotating main bearing II.

For this, a processing unit 11 in the form of an additional grinding unit is employed that is preferably embodied with a spindle unit in the form of a motor spindle. This motor spindle in its front region at its spindle nose receives a grinding wheel 10.

In order for this additional grinding device 11 to be able to be pivoted to the crankshaft, it must stand parallel to the Z axis, which the CNC axis of the grinding table represents, and the grinding wheels 13 must be moved out of the way by means of the X axis, which moves the grinding spindle head 12 into place.

In order that the crankshaft 1 does not have to be moved in the direction of the X axis, during grinding of the steady seat this additional grinding device 11 is pivoted such that the narrow grinding disk 10 is arranged for grinding the steady seat largely centered in front of a grinding wheel 13 of the grinding wheel set of the grinding spindle 12. The X axis, which moves the grinding spindle head, upon which the additional grinding device 11 is also installed, is used so that the grinding wheel 10 can be moved to the crankshaft.

FIG. 1 furthermore illustrates the grinding spindle 12, which has a center axis 14 that runs exactly parallel to the crankshaft, about which the grinding wheels 13 are rotatable for processing the main bearings I through IV.

The main bearings on the crankshaft 1 that are to be ground are labeled 15.

In order to keep the cutting pressure during grinding of the steady seat as low as possible, the grinding wheel 10 has a width of approx. 10 to 12 mm, whereby the steady jaws are for instance approx. 8 mm wide. A grinding wheel made of aluminum or a CBN grinding wheel, for instance, can be employed for grinding means for grinding the steady seat.

In the present example the additional grinding device 11 is described as a pivotable unit. However, it is also possible either to drive or pivot this additional grinding device 11 to any position within the grinding machine.

Figure 2:
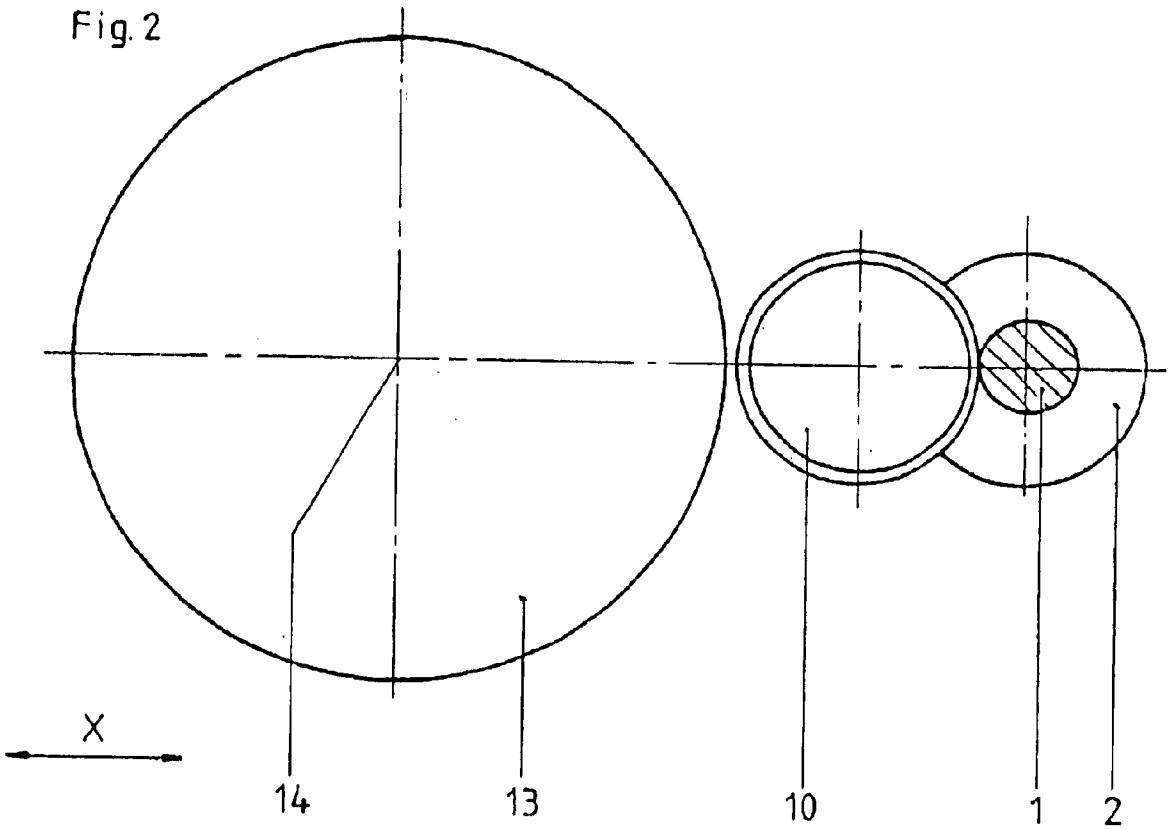
FIG. 2 is a simplified schematic side elevation for illustrating the arrangement of the individual grinding wheels.

FIG. 2 is a highly simplified side elevation in the region of the main bearing II in FIG. 1. The grinding wheel 10 for grinding the steady seat is arranged in front of a grinding wheel 13 of the grinding spindle 12. The crankshaft 1 is shown in section. As can be seen, the center axes of each of the grinding wheels 10 and 13 and the center axis of the crankshaft 1 are parallel, whereby these center axes are preferably in one horizontal plane.

Figure 3:
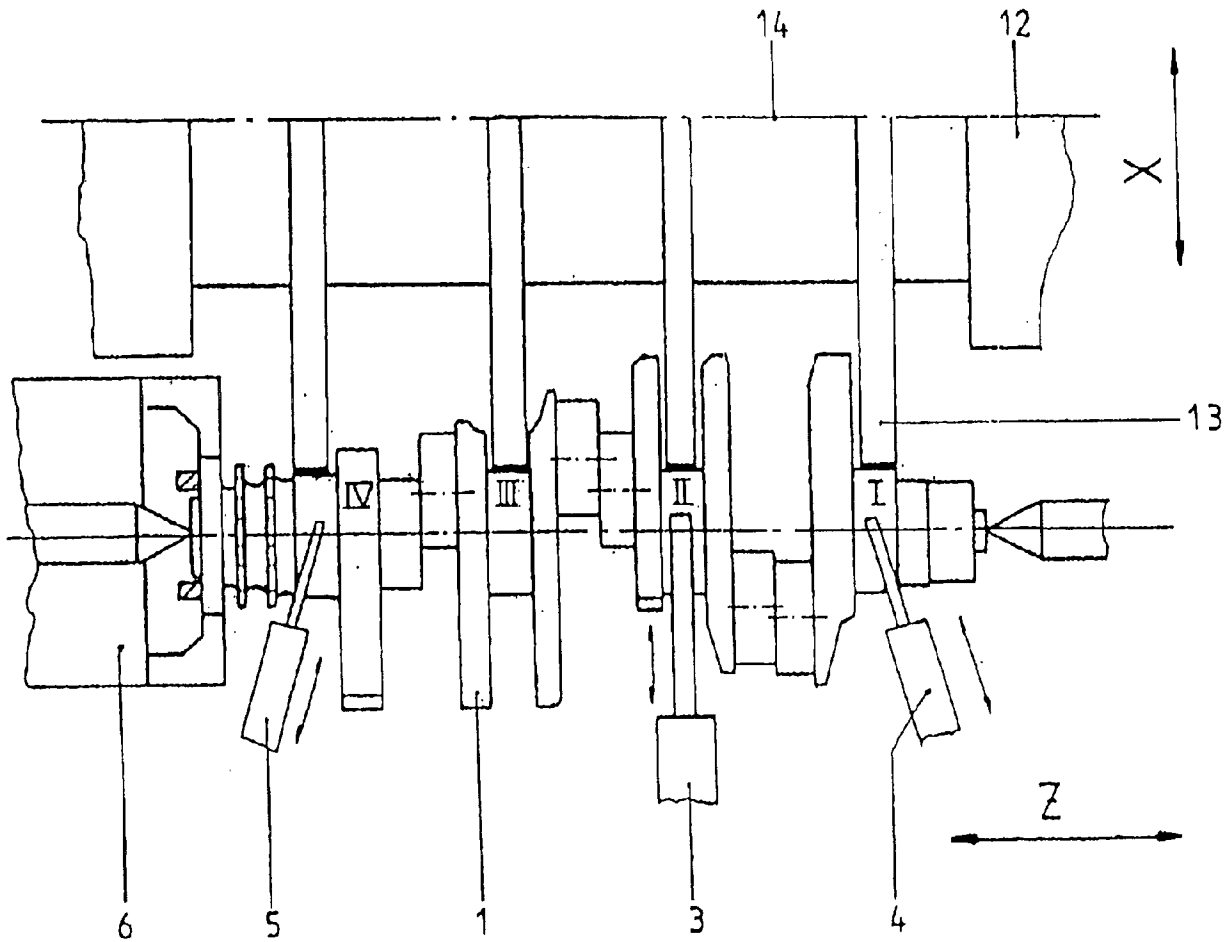
FIG. 3 is a schematic top view during multilayer grinding of the crankshaft.

FIG. 3 now illustrates the final process in multilayer grinding of the bearings I through IV, whereby these are now ground simultaneously. This is necessary since all of the grinding wheels 13 are received on the grinding spindle 12, which is borne bilaterally. The grinding wheel set is moved into position by means of the X axis, CNC controlled. During the multilayer grinding now, the jaws of the steady 3 are placed on the main bearing II so that the workpiece is very well supported during the grinding process. In order to attain exact diameters of the main bearings on the crankshaft 1, preferably one diameter-measuring head 4 and 5 is placed at each of the main bearings I and IV. During grinding, the crankshaft 1 is continuously monitored with respect to target and actual measurement. Corrections then occur via the CNC control of the machine, whereby the measuring devices constantly receive the actual values for the diameter of the main bearings I and IV. As soon as the target measurement has been attained at one of the main bearings of the crankshaft 1, the grinding cycle is terminated and the grinding spindle 12 moves out of the way.

Although FIG. 3 illustrates grinding of the main bearings on the crankshaft 1, it is not possible for additional center sections of the crankshaft 1 to be ground in the same clamp with a correspondingly modified grinding wheel set.

Figure 4:
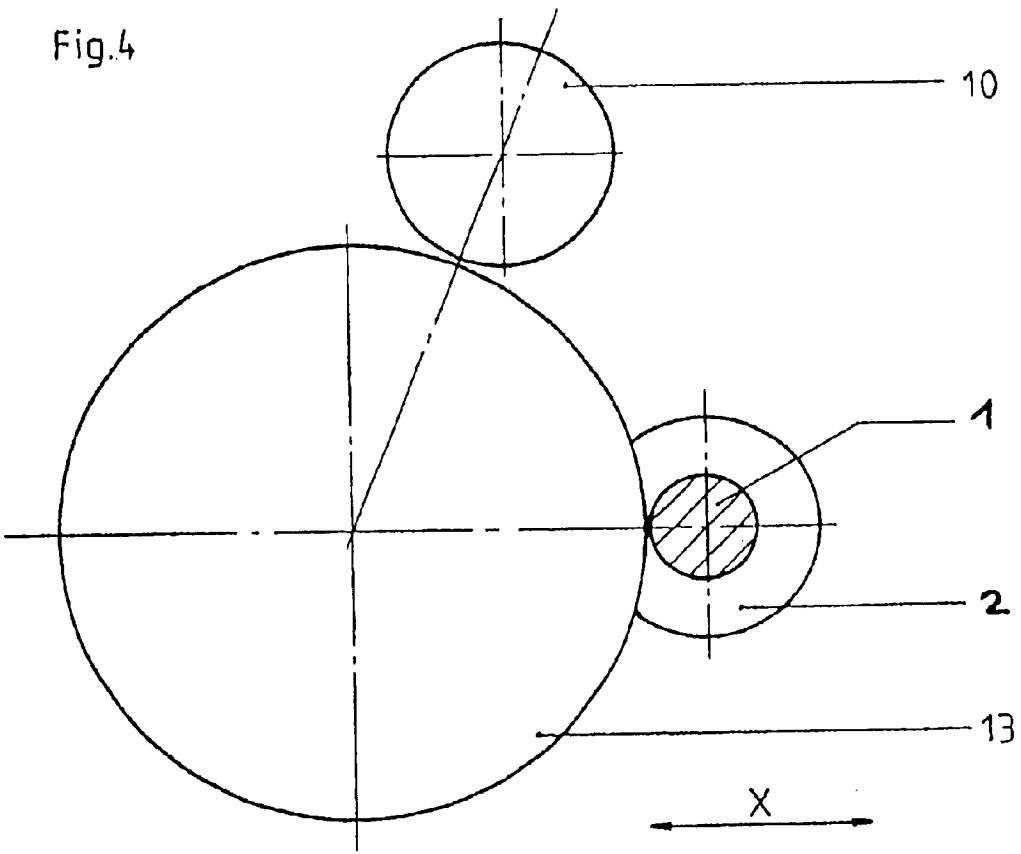
FIG. 4 is a simplified schematic side elevation with the additional grinding device outwardly pivoted.

FIG. 4 is a simplified side elevation of the top view illustrated in FIG. 3 in the region of the work area of the main bearing H:. As can be seen, the additional grinding device 11 with the grinding wheel 10 has been pivoted upward; however, it is also conceivable that it can be pivoted in or out or driven into any other desired position depending on the design of the grinding machine and the space available.

Figure 5:
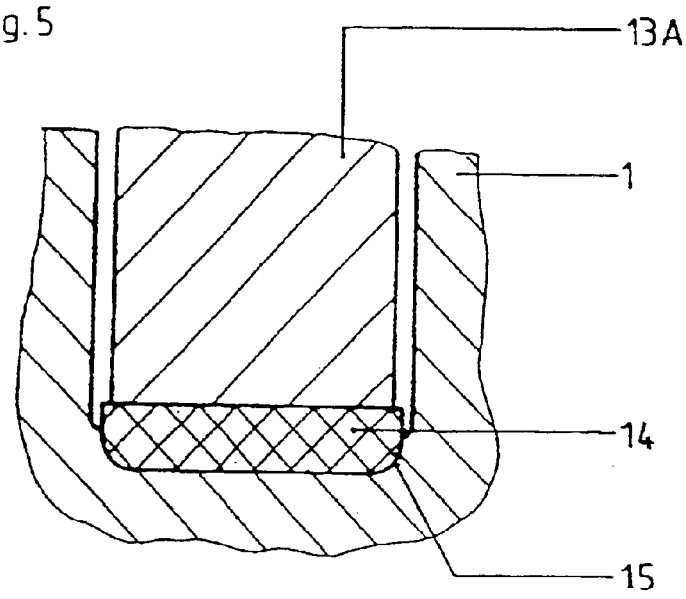
FIG. 5 is a contact by the grinding wheel while grinding with bearings with lateral radii; and, FIG. 6 is grinding of a steady seat at a bearing with pre-processed elevated running track.

FIG. 5 illustrates in detail the grinding process with the grinding wheel 13 on the main bearing of the crankshaft 1, whereby the base body of the grinding wheel is labeled 13A and the CBN coating is labeled 14. In general, the coating height is approx. 5 mm. As can be seen, the lateral radii 15 on the main bearing of the crankshaft 1 are also ground in this case; For instance, a face shoulder height of approx. 4 to 5 mm is ground on the radius transition with respect to the face surfaces.

Figure 6:
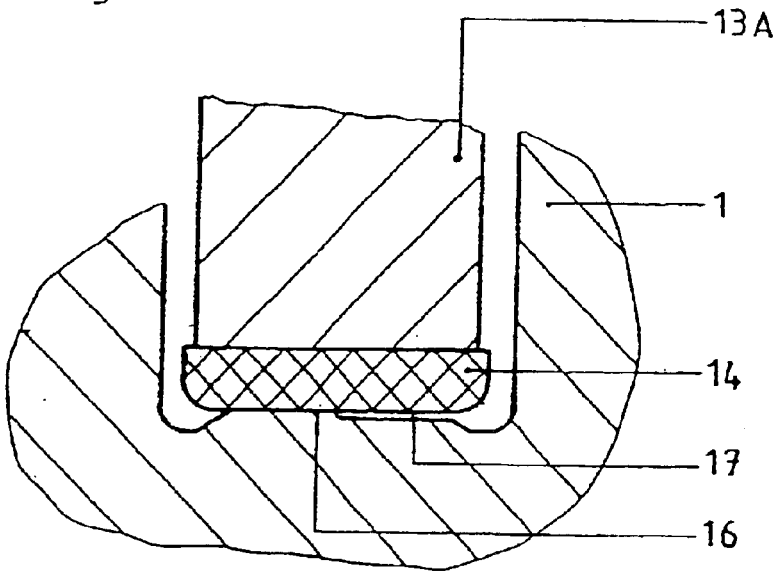

FIG. 6 is a simplified illustration of how grinding occurs on the main bearing with the grinding wheel 13. The main bearing has an elevation 16 that was created by preprocessing, for instance rotational milling or turning on a separate apparatus. It is plain to see that the grinding wheel 13 is only in grinding contact at the elevation 16 on this main bearing, whereby however the lateral zones 17 and the other main bearings of the crankshaft 1 are not also ground during grinding of the steady seat. The steady is placed once grinding of the steady seat has begun on the circumference of the elevation 16.

Then the grinding wheel set is again moved into place so that the crankshaft 1 can be ground to the finished final dimensions.

Legend

1 Crankshaft
2 Main bearing I, II, III, IV
3 Steady
4, 5 Measuring device
6 Chuck
7 Longitudinal stop
8, 9 Centering tips
10 Grinding wheel
11 Processing unit, additional grinding device
12 Grinding spindle
13 Grinding wheel
14 Center axis
15 Lateral radii
16 Elevation
17 Lateral zones

What is claimed is:

1. Apparatus for grinding center bearings of a crankshaft, comprising:

a clamping unit for clamping and driving said crankshaft in an axis of its rotation;

a grinding spindle unit with a grinding spindle, said grinding spindle having an axis of rotation parallel to said axis of rotation of said crankshaft, and said grinding spindle being positionable perpendicular to said crankshaft;

a plurality of grinding wheels on said grinding spindle, corresponding to a number of center bearings to be ground;

a plurality of steadies, for supporting said crankshaft, opposite said grinding spindle, at least one of which supports said crankshaft in a region of at least one center bearing; and an additional machining unit for performing preliminary grinding on at least one center bearing, by forming an elevated bearing seat for said steadies, opposite said bearing, such that said steadies are continuously guidable during grinding of said center bearings and provide counter-support.

2. Apparatus according to claim 1, wherein said additional machining unit has at least one grinding wheel.

3. Apparatus according to claim 2, wherein said at least one grinding wheel of said additional machining unit has a width that is less than a width of said center bearings.

4. Apparatus according to claim 2, wherein said at least one grinding wheel is a cubic boron nitride (CBN) grinding wheel.

5. Apparatus according to claim 1, wherein said additional machining unit alternatively is driveable into and pivotable into contact with said crankshaft, between said crankshaft and said grinding spindle, when said grinding spindle is in a non-contact position.

6. Apparatus according to claim 5, wherein a drive for said additional machining unit is separate.

7. Apparatus according to claim 1, wherein said steady is positionable at a center bearing of said crankshaft.

8. Method for grinding center bearings of a crankshaft, comprising simultaneously grinding said center bearings of said crankshaft using a wheel set for the grinding of multiple bearings, wherein prior to a final grinding of said center bearings of said crankshaft to final dimensions, a bearing seat for a steady is ground on at least one said center bearing, said steady having different dimensions from said final dimensions of said center bearings, and wherein said steady is guided during grinding of said bearing seat to its final dimensions.

9. Method according to claim 8, wherein said bearing seat is initially ground with a first grinding wheel; said steady is placed; and grinding of said center bearings of said crankshaft is completed using said grinding wheel set.

10. Method according to claim 8, wherein said bearing seat is initially ground with a grinding wheel of said grinding wheel set to an elevated contour of a main center bearing; said steady is placed; and grinding of said center bearings of said crankshaft is completed.

* * * * *